United States Patent [19]

Hoffmann et al.

[11] Patent Number: 4,924,614

[45] Date of Patent: May 15, 1990

[54] GUN BARREL CONSTRUCTION

[75] Inventors: Dietrich Hoffmann, Schramberg; Harald Weisser, Oberndorf, both of Fed. Rep. of Germany

[73] Assignee: Mauser-Werke Oberndorf GmbH, Oberndorf, Fed. Rep. of Germany

[21] Appl. No.: 710,981

[22] Filed: Mar. 12, 1985

[30] Foreign Application Priority Data

Mar. 13, 1984 [DE] Fed. Rep. of Germany ..... 3409073

[51] Int. Cl.[5] ..... F41C 21/00

[52] U.S. Cl. ..... 42/78

[58] Field of Search ..... 42/78

[56] References Cited

U.S. PATENT DOCUMENTS

| | | | |
|---|---|---|---|
| H278 | 6/1987 | Steiner | 42/78 |
| 315,746 | 4/1885 | Costa de Arguibel | 42/78 |

FOREIGN PATENT DOCUMENTS

| | | | |
|---|---|---|---|
| 51469 | 3/1910 | Fed. Rep. of Germany | 42/78 |
| 291541 | 6/1953 | Fed. Rep. of Germany | 42/78 |
| 15894 | of 1889 | United Kingdom | 42/78 |
| 127849 | 6/1919 | United Kingdom | 42/78 |

*Primary Examiner*—Charles T. Jordan
*Assistant Examiner*—Michael J. Carone
*Attorney, Agent, or Firm*—McGlew & Tuttle

[57] ABSTRACT

The invention discloses a gun barrel with a novel pattern of a rifling curve. The latter proceeds at start of motion from the parabolic curve $y=A+Bx+Cx^2$ and is supplemented with a constant D, to which is added a freely selectable exponent =d. Due to the freely selected exponent as parameter the ridge force maximum can be displaced at almost equal level between the start of motion and the barrel mouth. At the barrel mouth the ridge force drops to a minimum.

5 Claims, 3 Drawing Sheets

GUN BARREL CONSTRUCTION

FIELD AND BACKGROUND OF THE INVENTION

The invention relates in general to firearms and in particular to a new and useful gun barrel with a traction field profile (Zug-Feld-Profil) whose rifling pattern builds on the law of the parabolic rifling curve $y=A+Bx+Cx^2$.

The rifling pattern of gun barrels is fixed according to the particular requirements, as for example flight stability of the projectiles and strain of the gun barrels and of the driving bands of projectiles. From "Waffentechnisches Taschenbuch", Rheinmetall, 1980, pages 523 to 529, several types of rifling and the curve of the ridge force (Leistenkraft) versus the projectile path in the gun barrel are known. The types of rifling more frequently used are constant rifling, parabolic rifling, and circular rifling. All these types, however, have a variety of disadvantages. Constant rifling has a strong ridge force or guide force rise with the disadvantage of high load on the driving bands and on the projectiles at the start of motion in the gun barrel. This is caused by the fact that the ridge force maximum is located at the point of maximum gas pressure. In progressive rifling, which includes both the parabolic and the circular rifling, the ridge force maximum occurs at the mouth of the gun barrel, with adverse effect on the exit ballistics of the projectiles. Often a constant rifling is appended to the progressive rifling, in order thus to reduce the ridge forces in this zone. At the interfaces between progressive and constant rifling, however, jumps occur in the shape of the ridge force curve, again with an adverse effect due to the wear of the gun barrel.

As is made clear in particular by FIG. 1137, page 525, in "Waffentechnisches Taschenbuch", Rheinmetall, 1980, with constant rifling the ridge force maximum occurs at the point of the gas pressure maximum. The sharp ridge force increase immediately at the beginning of projectile motion has the result that besides the high load of the driving band and of the projectile the powder gases are very hot in this region and thereby the barrel erosion is greatly accelerated. With parabolic rifling, on the contrary, there is less stress on the projectile and driving bands at the start of motion. The ridge force rise has a relatively flat slope. However, as the projectile leaves the gun barrel, high ridge forces act on the barrel mouth, thereby adversely effecting the accuracy of fire.

SUMMARY OF THE INVENTION

The invention provides a gun barrel which has a longer life, reliably permits an improved impact diagram, and reduces the stress on the projectiles and driving bands during passage through the barrel.

According to the invention the rifling pattern following the law of the parabolic rifling curve $y=A+Bx+Cx^2$ is supplemented to the effect that, in the vicinity of the barrel mouth, the rifling rise is rise-free with decreasing ridge force, the location of maximum gas pressure is separated from the ridge force maximum, and the summit of the ridge force curve can be shifted on the projectile path in the region between the gas pressure maximum and the barrel mouth at a substantially equal or almost equal level by a freely selectable exponent of a constant which is greater than two.

According to the invention, the rifling curve $y=A+Bx+Cx^2$ can be supplemented by a futher summand with two constants, one of which is in the exponent and is freely selectable and can assume all values greater than two, and according to the selection of the exponent, the summit of the ridge force curve can be displaceable on the projectile path between the regions of the gas pressure maximum and the barrel mouth at equal or almost equal level.

As proposed by the invention, the rifling pattern starts with a slot rise of the ridge force at the start of the motion of the projectile, the maxima of gas pressure and ridge force are separated and end with a minimization of the ridge force at the barrel mouth, and can also include a free selectability of the location of the ridge force maximum in adaptation to the particular gas pressure pattern of an actual ammunition and to the geometry and material of the gun barrel.

According to a further aspect of the invention, the constant of the supplementing summand $Dx^d$ is advantageously subject to the additional conditions that the second derivation of the rifling curve at the coordinate $x_E$ of the barrel mouth is taken as zero in order to minimize the ridge forces at the barrel mouth, and the first constant A of the rifling curve for start of rifling at the coordinate origin is likewise taken as zero, while the exponent as parameter controls the location of the ridge force maximum.

To keep the ridge force maximum sufficiently far away from the gas pressure maximum, the exponent may be a number between four and twelve. On the projectile path the rifling pattern according to the invention is based on:

(a) a ridge force which has a rise following the law of the parabola, in particular the cubic parabola, and which after the maximum drops to a ridge force minimum at the barrel mouth;

(b) a rifling angle with a rise continuous to close to the barrel mouth and with a flattening in the region of the barrel mouth to a zero rifling angle rise;

(c) a rifling rise which progresses continuously from the start of the motion and which has a zero inclination up to or at the barrel mouth; and (d) a rifling curvature which extends into or almost to the region of the barrel mouth as a straight line at equal level and continuously decreases to zero at the barrel mouth.

A rifling pattern of gun barrels with the above features presents a number of advantages over the state of the art.

The entire rifling development combines all positive properties of constant and of parabolic rifling without possessing the disadvantages thereof. Jumps no longer occur in the ridge force, and for the first time it becomes possible to shift the position of the ridge force maximum at will.

The rifling curve of the invention $y=A+Bx30\ Cx^2+Dx^d$ with the conditions that the exponent d is not equal to 1.2 in order thus to exclude the constant and the parabolic rifling, and with the second derivation of the rifling curve at the location of the barrel mouth, namely $y''(X_E)=0$, causes a minimization of the ridge force at the barrel mouth. The initial portion, know in itself, $A+Bx+Cx^2$, produces a slow rise of the ridge force at the start of the motion of the projectile. The freely selectable exponent=d causes the displaceability of the ridge force maximum in the gun barrel. The great advantage of this is that the maximum value of the ridge force changes insignificantly with the displacement. With increasing exponent=d the ridge force maximum shifts in the direction of the gun barrel mouth. In tests it was found that optimum values were between four and twelve.

To summarize the following advantages which are achieved with the invention: P 1. Minimization of the ridge forces at the barrel mouth for improved exit properties and consequent accuracy of fire of the projectiles;

2. Separation of the maxima of gas pressure and ridge force to reduce barrel erosion in the region of high gas pressures, which are coupled with the occurrence of high barrel temperatures;

3. Slow rise of the ridge force at the start of the motion to avoid strong or sudden loads for the driving bands, in particular plastic driving bands;

4. Free selectability of the position of the ridge force maximum, adapted to the particular gas pressure pattern of an existing ammunition and to the load capacity of a gun barrel of given geometry and given material.

At given system parameters, the constants A and B follow necessarily. At a fixed selection of the exponent=d also the further constants C and D are uniquely determined.

Accordingly it is an object of the invention to provide an improved gun barrel having a novel pattern of rifling curve and which is simple in design rugged in construction and economical to manufacture.

DESCRIPTION OF THE PREFERRED EMBODIMENTS

Figure 1:
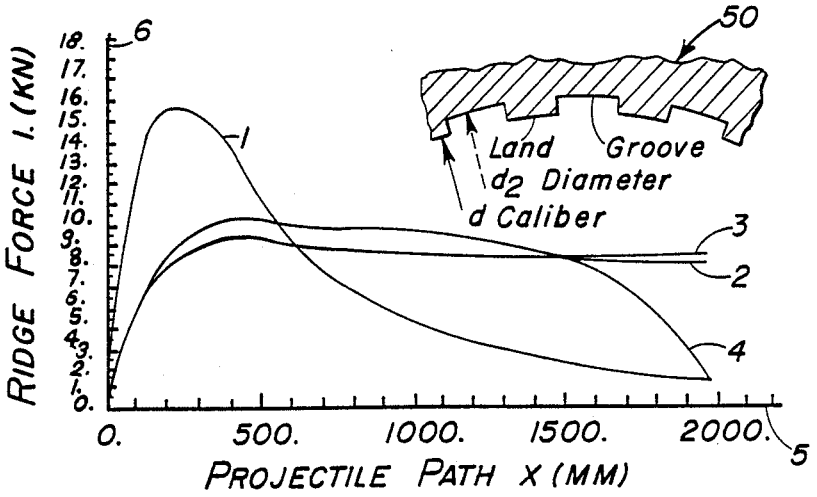
FIG. 1 is a curve showing the ridge force versus the projectile path in the curve diagram and a sectional view of a gun barrel constructed in accordance with the invention.

Referring to the drawings the invention embodied therein comprises a gun barrel generally designated 50 having a novel pattern of a rifling curve which supplements the motion of a parabolic curve with a constant D to which is added a further selectable exponent d so that the ridge force maximum can be displaced at almost equal level between the start of motion and the barrel mouth where the ridge force drops to a minimum.

According to the invention, the rifling curve of the invention it follows the relationship $y=A+Bx+CX^2+DX^d$ with the condition that the exponent d is not equal to 1.2. This requirement that d is greater than 1.2 excludes a constant and therefore excludes the parabolic rifling curve. The second derivative of the rifling curve at the location of the barrel mouth, namely $y''(X_E)=0$ causes a minimization of the ridge force or guide force at the barrel mouth or at the muzzle. The initial portion of the relationship, $A+BX+CX^2$, produces a slow rise of the guide force at the beginning of the movement of the projectile. The variable d provides for the displaceability of the guide force maximum in gun barrel. This provides a major advantage as the maximum value of the guide force varies only negligibly as a result of the displacement. With the increasing exponent d, the guide force maximum shifts in the direction of the muzzle.

The curve diagrams of FIGS. 1 to 4 always relate to a gun barrel in the 25 mm caliber. Also, all curve diagrams of FIGS. 1 to 4 have in common that the constant A from the rifling curve $y=A+Bx+Cx^2$ is always taken as zero, because the start of rifling was placed in the coordinate origin.

Now FIG. 1 elucidates the advantages of the new rifling curve over the ridge forces 6, there having been selected here the comparison with the constant rifling curve 1, with the parabolic rifling curve 2 and with the circular rifling curve 3.

The ridge force at constant rifling 1 rises steeply on a short projectile path 5. As a disadvantage precisely at this point the gas pressure maximum is represented. Curve 1 then drops quickly and has an advantageously low value at the barrel mouth. The rifling curves 2 and 3 have an almost identical shape. While the ridge force rise is slow, curves 2 and 3 remain at a high level, pointing to the great ridge force at the barrel mouth. The rifling curve 4 of the invention, on the contrary, has the advantages of the slow rise of the curves 2 and 3 and at the same time also the low value of the ridge force at the barrel mouth. Responsible for this curve shape is the supplementary value of the invention with a constant and with a freely selectable exponent.

Figure 2:
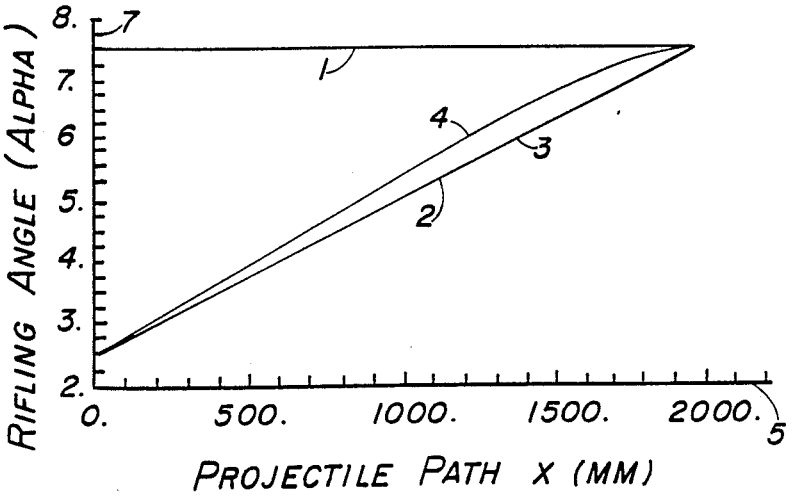
FIG. 2 is a curve showing the rifling angle versus the projectile path in the curve diagram.

FIG. 2 shows the rifling angle 7 in degrees versus the projectile path 5 for constant rifling 1, parabolic rifling 2 and circular rifling 1 extends without angle changes over the entire projectile path 5, in the substantially identical rifling curves of parabolic rifling 2 and circular rifling 3 the curve of the rifling angle rises continuously. This is true also of the region of the barrel mouth. Here, too, the inventive rifling 4 provides an advantage with its gentle rise at the start of the motion to over an arc at the end of curve 4 at the barrel mouth, where the rifling angle 7 runs parallel with the constant rifling 1.

Figure 3:
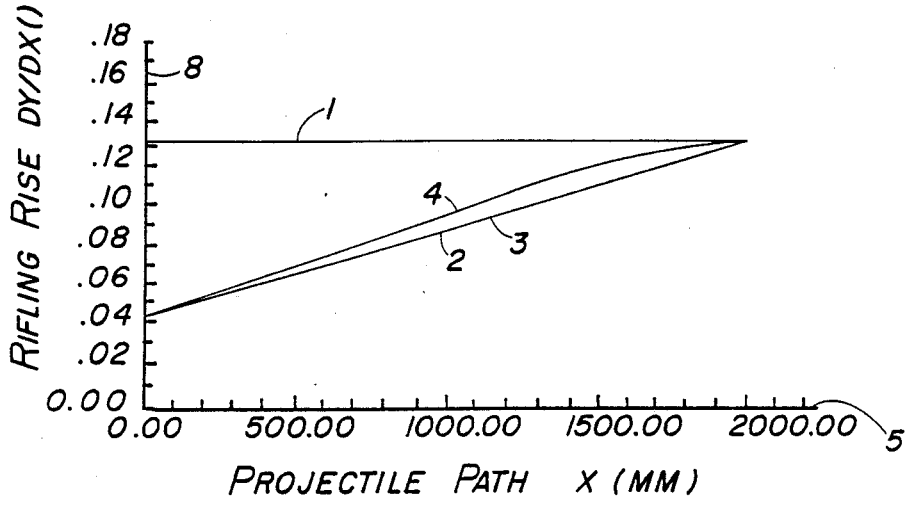
FIG. 3 is a curve showing the rifling rise versus the projectile path in the curve diagram.

In FIG. 3 the curves of the rifling rise 8 extend in almost identical manner for constant rifling 1, parabolic rifling 2, circular rifling 3 and the rifling 4 of the invention, where the rise at the barrel mouth is zero. The rifling rise is calculated from the first derivative dy/dx.

Figure 4:
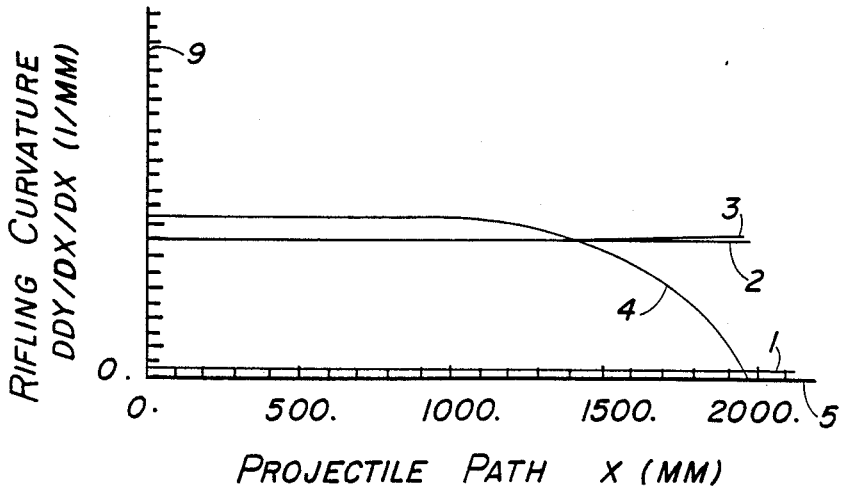
FIG. 4 is a curve showing the rifling curvature versus the projectile path in the curve diagram.

FIG. 4 shows the rifling curvature 9 as the second $d^2y/dx^2$ for the rifling types constant 1, parabolic 2, circular 3, and of the invention 4. It is clearly evident here that only with then new rifling 4 the curve of the rifling curvature 9 drops in the form of an arc to the value zero.

Figure 5:
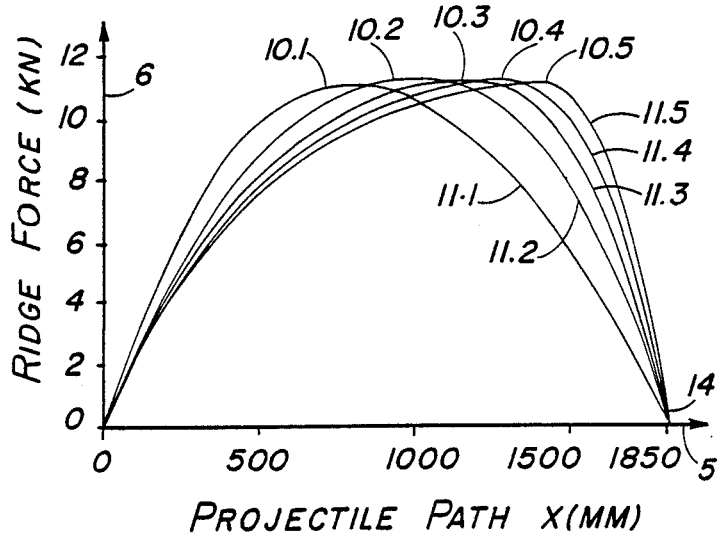
FIG. 5 is a curve showing the ridge forces for a caliber of 27 mm with various exponents.
Figure 6:
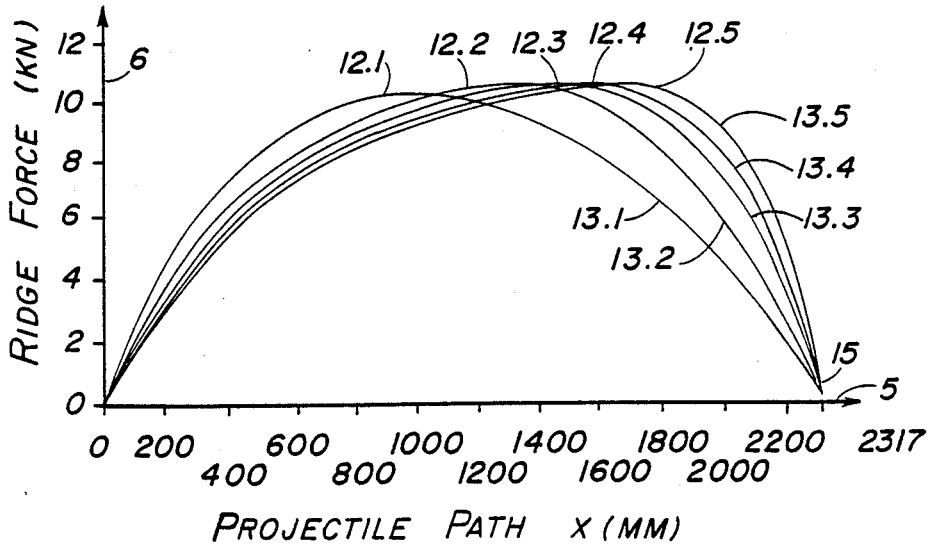
FIG. 6 is a curve showing the ridge forces for a caliber of 30 mm with various exponents.

In FIGS. 5 and 6 the ridge forces 6 in kilonewtons versus the projectile path 5 in the example of a machine gun of 27 mm caliber (FIG. 5) and 30 mm caliber (FIG. 6) at different exponents. The formulation for the rifling development occur in both cases by $y=A+Bx+Cx^2+Dx^d$.

For the curves according to FIG. 5 the premises are:

$X_A=Y_A=0$ for the rifling start $Y'(X_A)=\tan \alpha_A$; $\alpha_A=0°$ starting rifling angle $Y'(X_E)=\tan \alpha_E$; $\alpha_E=7°50'$ end rifling angle $Y''(X_E)=0$ for the minimization of the ridge force at the barrel mouth.

Inclusion of the above limit conditions in the formulation of the rifling function will result in the expressions:

$$A+Bx_A+Cx_A^2+Dx_A^d=0$$

$$B+2Cx_A+dDx_A^{d-1}=\tan\alpha_A$$

$$B+2Cx_E+dDx_E^{d-1}=\tan\alpha_E$$

$$2C+(d-1)dDx_E^{d-2}=o$$

From this result after insertion, subtraction and combination:

$$A = 0$$
$$B = \tan\alpha_A'$$

$$C = \frac{(d-1)(\tan\alpha_A - \tan\alpha_E)}{(d-2)\,2\,X_E}$$

$$D = \frac{\tan\alpha_A - \tan\alpha_E}{(d-2)\,dx_E^{d-1}}$$

From this it is evident that as free variable there remains only the power=d.

By suitable selection of the d the ridge force maximum can be shifted to almost any desirable point between $x_A$ and $x_E$.

FIG. 5 now shows the displacement of the ridge force maximum at points 10.1, 10.2, 10., 10.4 and 10.5 for the freely selected exponents=d: 11.1 with the value 4, 11.2 with the value 6, 11.3 with the value 8, 11.4 with the value 10, and 11.5 with the value 12. With increasing exponents toward 11.5 the ridge force maximum shifts in the direction of the gun barrel mouth, where it then drops off more or less steeply according to the distance from the barrel mouth. Despite the displacement, the ridge force maximum remains at almost the same level.

The curves in FIG. 6 are very similar. In this example of a 30 mm caliber machine gun the following premises were selected:

$X_A=Y_A=0$ for start of rifling $Y'(X_A)=\tan\alpha_A$; $\alpha_A=2.5°$ initial rifling angle $Y'(X_E)=\tan\alpha_E$; $\alpha_E=8.5°$ final rifling angle $Y''(X_E)=o$ for the ridge force minimum at the barrel mouth.

Here, too, the ridge force maximum 12.1, 12.2, 12.3, 12.4 and 12.5 remains at almost the same level, while over the projectile path 5 it is provided according to the freely selected exponent=d; for 13.1 with the value 4, for 13.2 with the value 6, for 13.3 with the value 8, for 13.4 with the value 10, and for 13.5 with the value 12 in the direction of the barrel mouth.

In the statement of the limit conditions, $X_A$ always means the coordinate at start of motion and $X_E$ always means the coordinate of the barrel mouth.

The features of the invention that are crucial and also evident in the curve diagram are summarized:

Gentle rise of the ridge force curve to the maximum, then continuous drop without jump to a minimum 14,15 at the barrel mouth. Short-time ridge force peaks do not occur;

Rifling rise gentle and continuous, terminating in a horizontal tangent in arc form in the end portion of the curve, for which reason the inclination of the rifling is zero. This means that the rifling curvature has the value zero;

All curves according to the invention are continuous and can be differentiated any desired number of times;

The parameter=d determines how fast the ridge force drops to a minimum.

The smaller the value for d is taken, the flatter will be the drop. Conversely this means that at a large value for the parameter=d a steep drop occurs.

What is claimed is:

1. A gun barrel comprising: a rifled bore defining a projectile displacement path X and with a rifling twist Y running continuously from adjacent a gun barrel first end a first X coordinate value to a gun barrel muzzle having a muzzle X coordinate value, the rifling twist Y being described continuously over the entire projectile displacement path by a parabolic twist formula where $Y=A+BX+CX^2+DX^d$, where d is a variable between 4 and 12 with the rifling twist so described extending continuously over the entire projectile displacement path of the gun barrel between the first end and the muzzle where the second differential $d^2Y/dX^2$ of said twist formula at the muzzle X coordinate equals zero, thereby minimizing guide forces acting on a projectile at the muzzle.

2. A gun barrel according to claim 1, wherein A of the twist formula $Y=A+BX+CX^2+DX^d$ is zero where the first x coordinate equals zero coinciding with the origin of the twist.

3. A gun barrel according to claim 1, wherein a maximum gas pressure is generated in the gun barrel along the projectile path, and said rifling twist imparts on said projectile a maximum guide force varying in location according to the selected value of variable d between the muzzle and said point of maximum gas pressure.

4. A gun barrel comprising: a rifled bore defining a projectile displacement path X with a rifling twist Y running continuously from adjacent a first end of the gun barrel, having a first X coordinate, to a muzzle of the gun barrel, at a muzzle X coordinate, said rifling twist Y being described continuously from said first end to said muzzle by the parabolic twist formula $Y=A+BX+CX^2+DX^d$, where d is a variable selected between 4 and 12 and where the second differential ($d^2Y/dX^2$) of said twist formula at the muzzle X coordinate is equal to 0, said first X coordinate lying at the twist origin, such that the variable A is equal to zero, thereby providing a rifling twist imparting on a projectile a guide force which drops to a minimum at the muzzle and wherein the angle of twist over the projectile path increases up to a point adjacent the muzzle and reaches a zero angle of twist increase at the muzzle.

5. A gun barrel having a rifled bore defining a projectile displacement path and having a rifling twist Y described continuously over the entire projectile displacement path by the parabolic twist formula $Y=A+Bx+Cx^2$ modified by a summand $Dx^d$ wherein d is a variable of value between 4 and 12 such that by selecting increasing values of d a substantially constant peak guide force is shifted further away from a maximum gas pressure zone in the direction towards a muzzle, of the gun barrel, D is a constant such that the second differential of the twist formula at an X coordinate of the muzzle is zero in order to minimize the guide forces at the muzzle, and A is zero in a coordinate axis system having its origin at the beginning of the twist, whereby an increase in twist in the region of the muzzle is constant with falling guide force and the course of the twist begins with a slow increase in the guide force at the beginning of movement of the projectile.

* * * * *